United States Patent [19]

Marshall

[11] Patent Number: 4,518,126

[45] Date of Patent: May 21, 1985

[54] TAKE-UP MECHANISM

[75] Inventor: Bryce G. Marshall, Warwick, R.I.

[73] Assignee: Leesona Corporation, Warwick, R.I.

[21] Appl. No.: 511,417

[22] Filed: Jul. 6, 1983

[51] Int. Cl.[3] ..... B65H 54/02; B65H 54/20; B65H 57/28; B65H 59/38

[52] U.S. Cl. ..... 242/18 R; 242/35.5 R; 242/45; 242/157 R; 242/157.1

[58] Field of Search ..... 242/18 R, 45, 157.1, 242/43 R, 158 R, 35.5 R, 157 R

[56] References Cited

U.S. PATENT DOCUMENTS

| | | | |
|---|---|---|---|
| 736,472 | 8/1903 | Anderson | 242/157.1 X |
| 782,103 | 2/1905 | Bruner | 242/157.1 |
| 2,608,355 | 8/1952 | Bell et al. | 242/45 |
| 3,048,343 | 8/1962 | Keith | 242/45 |
| 3,350,022 | 10/1967 | Bense | 242/45 |
| 3,550,871 | 12/1970 | Keith | 242/45 |
| 3,822,832 | 7/1974 | Torii et al. | 242/45 |
| 4,232,838 | 11/1980 | Bravin | 242/157.1 X |

FOREIGN PATENT DOCUMENTS

| | | | |
|---|---|---|---|
| 2936181 | 3/1981 | Fed. Rep. of Germany | 242/45 |

*Primary Examiner*—Stanley N. Gilreath
*Attorney, Agent, or Firm*—B. W. Norton

[57] ABSTRACT

A take-up mechanism for a winding unit wherein yarns, tapes or other strands are wound on tubes or similar supports. The invention particularly relates to a compensator wheel mounted for pivoting so that it maintains alignment with the strand passing therearound in all operative positions of the compensator wheel. In another embodiment, the compensator wheel configuration includes a concave curvature which may be used in a conventional take-up mechanism in conjunction with certain strands such as carbon fibers which may suffer edge damage during winding.

18 Claims, 8 Drawing Figures

TAKE-UP MECHANISM

BACKGROUND OF THE INVENTION

This invention relates in general to new and useful improvements in the winding of strandular material such as filaments, fibers, and tapes onto tubes or spools and, more specifically, to the take-up mechanism for controlling the winding speed of the strand being wound.

In this specification the term "strand" is employed in a general sense to relate to all kinds of elongated strandular materials including yarns, fibers, tapes, filaments and the like.

Take-up machines wherein a strand being wound advances from overhead guide rolls and around a compensator wheel with the tension of the strand loop on the compensator wheel controlling the position of a support arm are well known. In such machines the position of the support arm acts to control the speed of a motor rotating the winding mechanism for effecting winding of the strand. In the known devices, the mounting arm for the compensator wheel is pivotally mounted for movement about a fixed axis of rotation of the compensator wheel. With such devices, in order to obtain the proper fanning angle for the strand with respect to the take-up spool or tube, it is necessary to maintain a substantial fanning length, i.e., the distance between compensator wheel and the take-up support. In modern plants space is at a premium and, accordingly, it is desirable to reduce the space necessary for a take-up mechanism so that a greater number of modular take-up units can be located in a given vertical space.

SUMMARY OF THE INVENTION

In accordance with the present invention there is provided a take-up mechanism wherein the compensator wheel is mounted for pivoting about an axis which is in alignment with the path of the strand to the compensator wheel, particularly the position of the compensator wheel relative to the pivot being one wherein the strand passing from the compensator wheel generally lays in a central plane of the compensator wheel.

Further, in accordance with the present invention it has been found beneficial to arrange the mounting arm of the compensator wheel for longitudinal movement along a fixed axis which is generally parallel to the pivot axis of the compensator wheel. With the mounting arm of the compensator wheel being so arranged for linear movement, a linear position responsive control device may be used for controlling the speed of the motor driving the winding mechanism, the compensator wheel being free to follow the traversing movement of the strand passing therefrom.

In addition to mounting the compensator wheel for pivoting above a fixed axis so that the compensator wheel may be free to follow the traversing movement of the strand passing therefrom, it is also feasible to provide the pivot shaft for the compensator wheel with a drive mechanism coupled to the conventional traversing device of the winding mechanism so that the compensator wheel is automatically pivoted in response to the traversing movement of the strand as it is being wound.

In the take-up mechanism of the present invention it is possible to substantially reduce the distance between the compensator wheel and the take-up spool, thereby reducing the fanning length of the strand being wound without reducing the fanning angle.

Also, in accordance with this invention there is provided an improved compensator wheel for use on a take-up mechanism which is provided with a concave strand guiding surface which serves to maintain the strand in contact with the compensator wheel as the strand traverses from one side to the other of a central plane of the compensator wheel without need for the edges of the strand to contact any surface. More specifically, the concave strand guiding surface is of a constant radius.

The aforesaid improved compensator wheel is particularly advantageous when certain strands, especially fully graphitized carbon fiber in tape form, are wound with a conventional take-up mechanism. As these materials traverse from one end to the other of the take-up spool on which they are being wound in the conventional take-up systems they are often damaged by engagement of the tape edges with the flanged edges of the compensator wheel. Although the damage to the tape edges could be eliminated by extending the distance between the compensator wheel and the tube on which the tape is being wound, it is desirable to have the entire take-up mechanism as compact as possible since plant space is often critical. This is accomplished by having the distance between the compensator wheel and the take-up tube as short as possible. The improved compensator wheel of this invention permits an effective take-up system, requiring a minimum space, without damage to the tape edges.

Having described the invention in general terms, specific and presently preferred embodiments will be set forth in the context of the illustrative drawing.

DESCRIPTION OF THE PREFERRED EMBODIMENT

Figure 1:
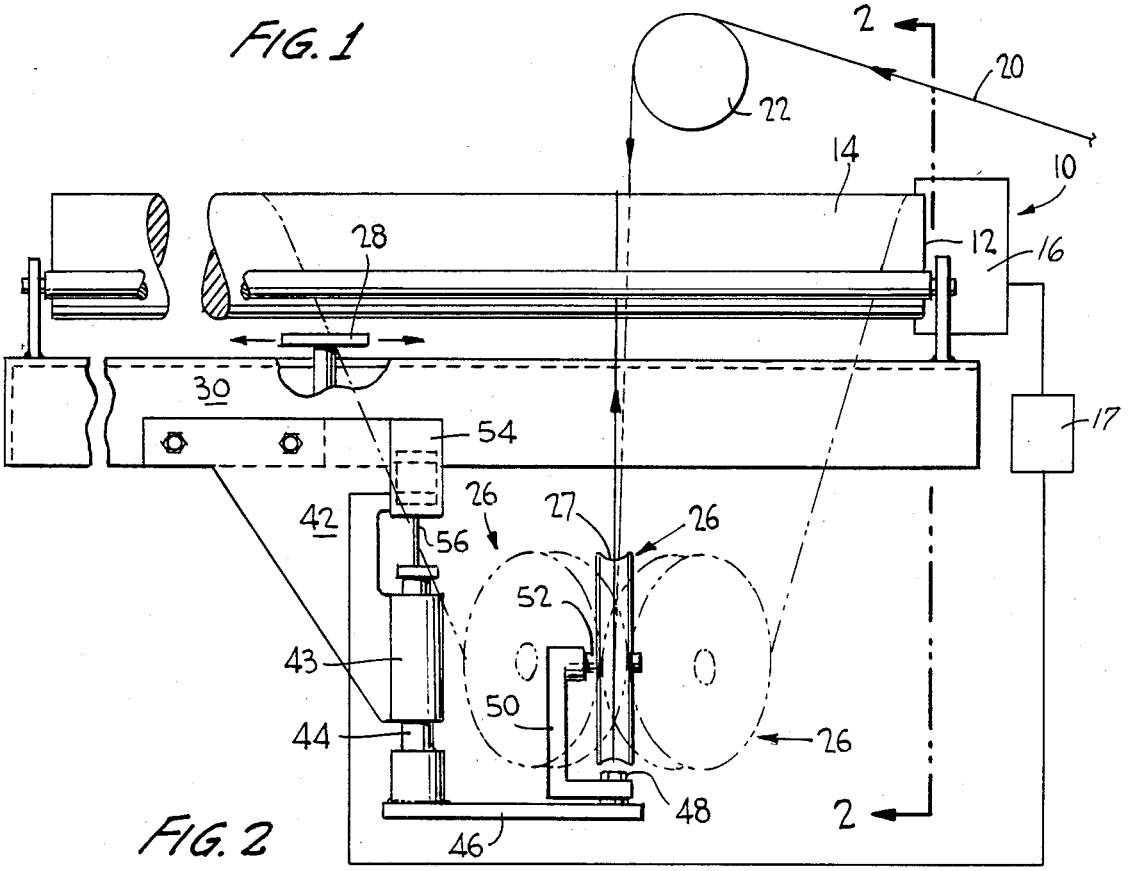
FIG. 1 is an elevational view of a take-up mechanism wherein the compensator wheel is mounted for pivotal movement and the support arm for the compensator wheel is mounted for linear movement along a fixed axis.
Figure 2:
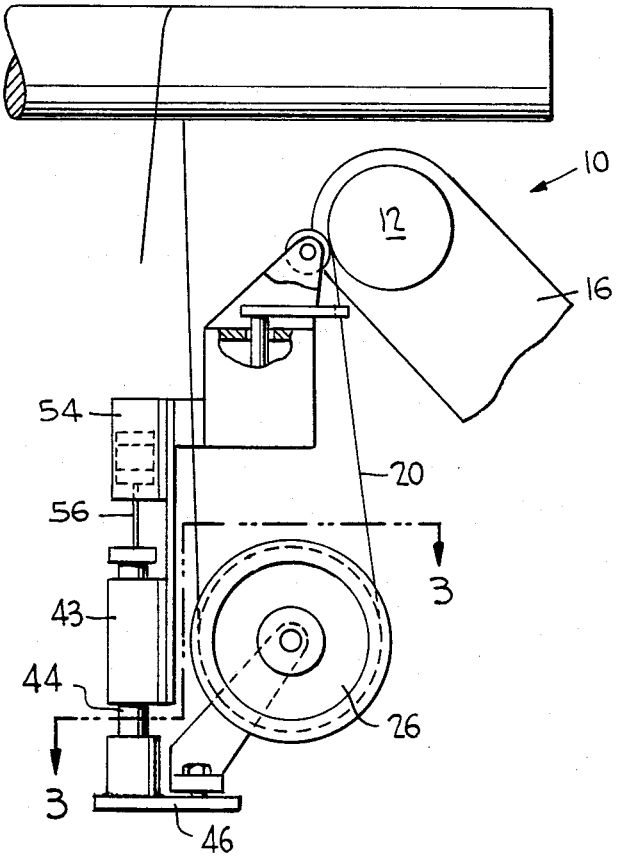
FIG. 2 is a side elevational view of the mechanism of FIG. 1 taken generally along the line 2—2 of FIG. 1, and shows more specifically certain details thereof.

Referring to FIGS. 1–4, the improved take-up mechanism is generally identified by the numeral 10, and may be mounted in any suitable manner. The device includes a winding mandrel 12 on which there may be removably positioned a tube or similar support 14 onto which a strand 20 is to be wound. The mandrel 12 is carried by a drive mechanism 16 for effecting its rotation. As shown in FIG. 5, the mechanism 16 is schematically illustrated as including a variable speed drive electric motor 18. Mechanism 16 is connected to drive control means 17.

Figure 4:
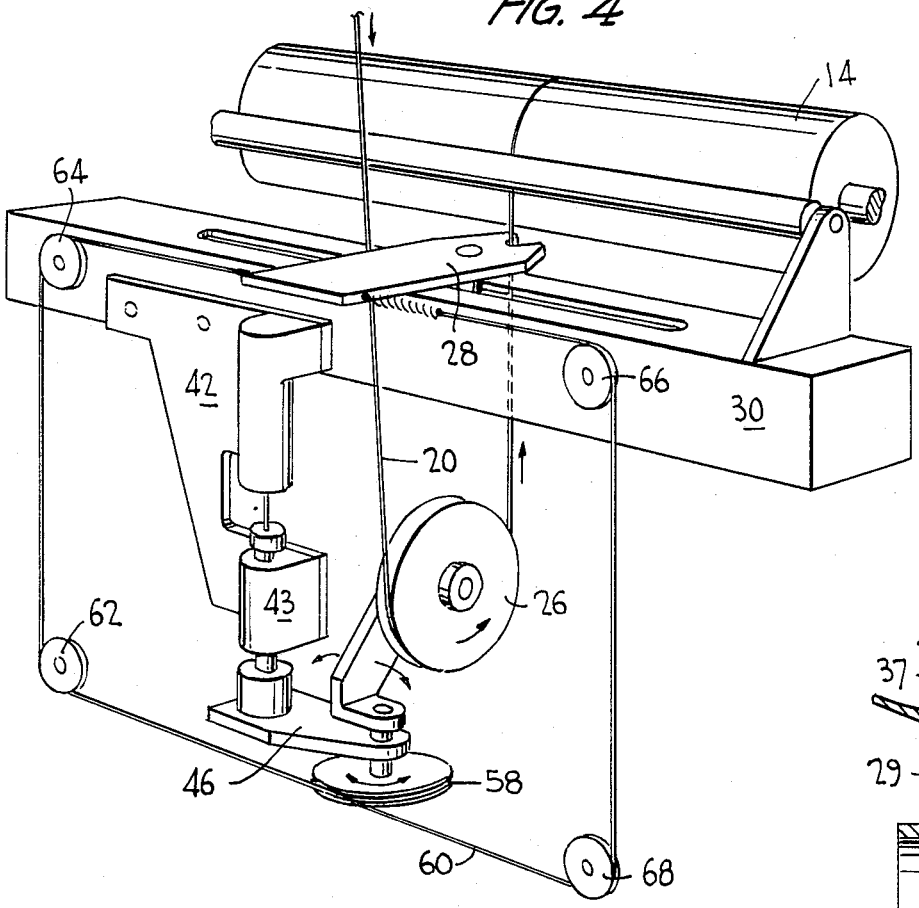
FIG. 4 is an elevational view of a take-up mechanism similar to that of FIG. 1 which includes a drive mechanism coupled to a conventional traversing device of the winding mechanism so that the compensator wheel is automatically pivoted in response to the traversing movement of the strand as it is being wound.
Figure 5:
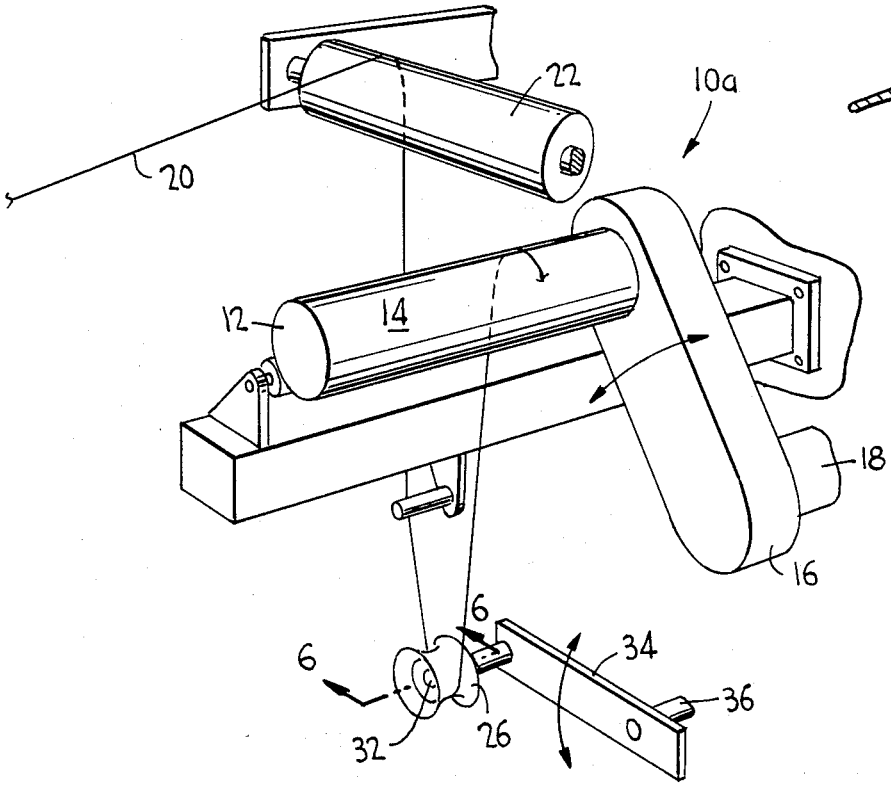
FIG. 5 is a perspective view of a take-up mechanism of a conventional type utilizing a compensator wheel improved in accordance with one aspect of this invention.

Strand 20 is delivered to the machine over an overhead guide roll 22 to a compensator wheel 26, and then up around the compensator wheel towards support 14 and mandrel 12 through a traversing guide 28 of a conventional sealed traverse mechanism 30, best shown in FIG. 4. In the illustrated embodiment of the invention there is a mounting bracket 42 secured on the housing of the traversing mechanism 30. The mounting bracket 42 is provided with a housing 43 in which a shaft 44 is mounted for axial movement on linear bearings (not shown). The shaft 44 carries at its lower end a mounting or arm 46 which holds the compensator wheel pivot shaft 48 in line with axis of strand 20.

The upstanding pivot shaft 48 carries a generally L-shaped support 50. The L-shaped support 50 carries a shaft or axle 52 on which compensator wheel 26 is mounted for rotation. Support 50 mounts the compensator wheel 26 so that it may swing or pivot about the incoming strand axis 20 as is best shown in FIG. 3, in accordance with the traversing of the strand 20.

Figure 3:
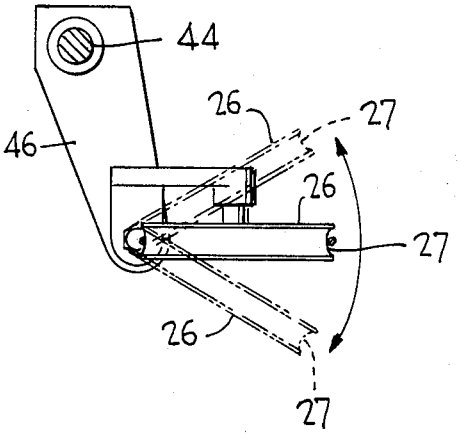
FIG. 3 is a fragmentary horizontal sectional view taken generally along the line 3—3 of FIG. 2, and shows the specifics of the mounting of the compensator wheel.

With particular reference to FIG. 3, it will be seen that the path of strand 20 to the compensator wheel 26 is in alignment with the axis of the pivot shaft 48. Thus, in all pivoted positions of the compensator wheel 26, the strand is directed against the central portion of the guiding surface 27 of the compensator wheel. Further, the mounting of the compensator wheel 26 and its relationship to the axis of pivot shaft 48 is such that the strand 20 leading from compensator wheel 26 generally lies in the central plane of compensator wheel 26 and all operative positions of the compensator wheel.

Mounting bracket 42 also carries a control device 54 of the linear position actuated type for controlling the speed of drive motor 18. Control device 54 is connected to drive motor 18 through drive control means 17. Control device 54 is conventional and is controlled by a rod or other type actuator 56 connected to the upper end of shaft 44. Thus, compensator arm 46, rather than pivoting as does compensator arm 34 as shown in FIG. 5, in accordance with the tension of the strand on the compensator wheel 26, the compensator arm 46 moves up and down longitudinally of the axis of shaft 44 so as to actuate control mechanism 54 in accordance with any variation in the tension of the strand on the compensator wheel to thereby speed-up or reduce the speed of the drive motor.

It is to be understood that pivot shaft 48 on the L-shaped support 50 is free to pivot or rotate relative to the compensator arm 46 and, thus, the compensator wheel 26 is normally free to pivot in accordance with the laterally traversing strand leading therefrom. However, if desired, pivot shaft 48 may be extended downwardly below compensator arm 46 as shown in FIG. 4 and be provided with a drive wheel 58 which has a cable 60 wrapped therearound which is coupled with strand traversing guide 28 of traversing unit 30 through a series of pulleys 62, 64, 66 and 68 to automatically pivot compensator wheel 26 in accordance with the actuation of the traversing unit 30.

Figure 6:
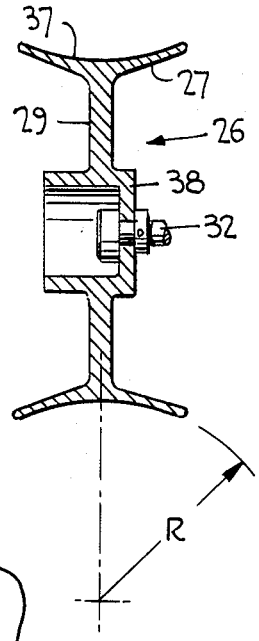
FIG. 6 is an enlarged fragmentary sectional view through the improved compensator wheel utilized in the mechanism of FIG. 5 and shows specifically the cross-section thereof.

Referring now to FIGS. 5 and 6 of the drawing, there is illustrated a winding and take-up mechanism generally identified by the numeral 10*a*. In this embodiment compensator wheel 26 is mounted for rotation about a shaft 32 carried by a mounting arm 34 which, in turn, is mounted for pivoted moving about a fixed axis determined by a shaft 36, the axis of the shafts 32 and 36 being parallel. There has been previously developed a control mechanism whereby, as determined by the rotation of the shaft 36, the speed of the drive unit 18 is varied in accordance with the position of the control arm 34 and resultant therefrom is the predetermined winding strand tension. The control, not shown, as in the mechanism of FIGS. 1–4 responds to any change in the speed of advance of strand 20. If the advance of strand 20 should increase over the winding speed, the weight loaded compensator arm 34 will drop, taking up the slack. When this happens arm 34 causes the control mechanism to increase the speed of spindle 14 which then pulls the arm 34 back up. When the arm reaches approximately a horizontal position the preset yarn tension is maintained and the machine is at the same speed as the line speed. If the strand speed should slow down, compensator arm 34 raises, slowing the machine down. Again, after the machine slows down, the arm 34 returns to the horizontal position. During a normal packaging operation, i.e., winding of strand on the support 14, compensator arm 34 remains substantially horizontal, moving only a few degrees, maintaining a desired yarn winding tension and substantially a constant surface speed.

Inasmuch as the strand traverses back and forth along mandrel 12 during the winding operation while the compensator wheel 26 remains substantially fixed except for moving up and down slightly with the mounting or compensator arm 34, compensator wheels in the past have been provided with lips or flanges so as to retain the yarn thereon. However, certain strands are damaged by edge engagement with such compensator wheel lip. Fully graphitized carbon fiber tape is one such strand where the pressure on the edges of the fiber tape deforms the tape. The improved compensator wheel as herein described eliminates edge contact with any surface and avoids consequent damage.

Referring now to FIG. 6, it will be seen that there is illustrated a specific compensator wheel 26 for handling a strand such as carbon fiber. Compensator wheel 26 includes a suitable hub 38 for rotatably mounting the same on the shaft or axle 32, and has a guide flange 27 carried by a body 29. Guide flange 27 has a strand guiding surface 37 which is the improved feature of compensator wheel 26. It is noted that the strand guiding surface 37 is arcuate and concave. In a preferred embodiment of the compensator wheel 26 the surface 37 is of a constant radius. It has been found that when the length of the support on which the strand is to be wound is in the order of ten inches, the diameter of the compensator wheel is preferably between one and three-quarter inches and five and one-half inches, with a diameter of three inches being optimum. It has also been found that the radius may vary between one inch and seven and one-half inches. A smaller radius will result in damage to the strand, and the strand will not track with a radius greater than seven and one-half inches.

It will be readily apparent that when the compensator wheel 26 is constructed as shown in FIG. 6 the usual side flanges or lips may be eliminated and, as the strand traverses, it will move across the face of guiding surface 37 but will remain in control of the guiding contact therewith at all times.

Figure 7:
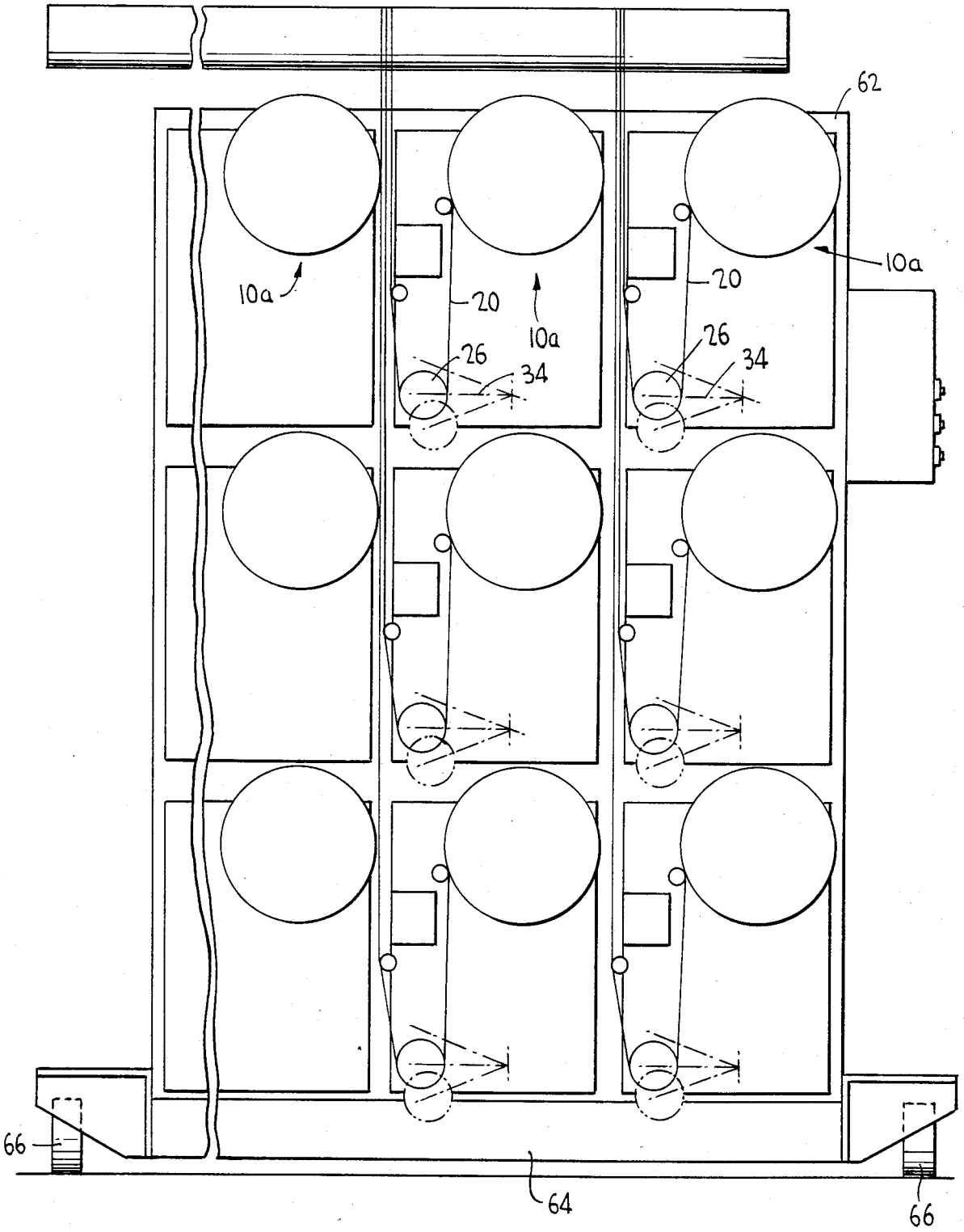
FIG. 7 is a side elevational view of a multiple head winding machine showing the manner in which a plurality of identical take-up mechanisms of the type shown in FIG. 5 may be mounted on a single cabinet.
Figure 8:
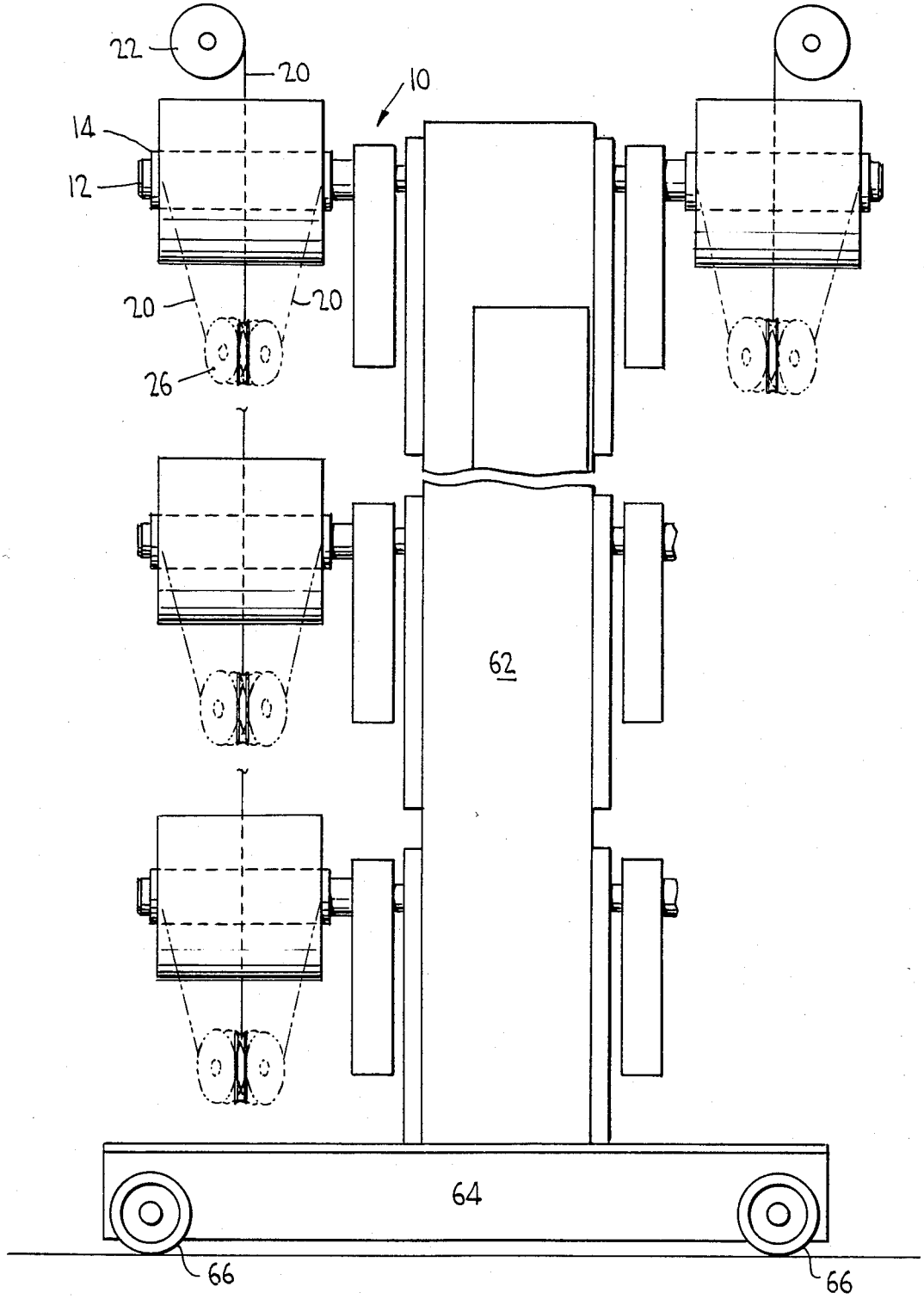
FIG. 8 is an end view of an assembly similar to FIG. 7 showing the mounting of take-up mechanisms on opposite sides of the cabinet of FIG. 7 and utilizing the take-up mechanism of FIGS. 1–4, permitting a substantial reduction in space between the take-up spool or tube and the compensator wheel.

Reference is now made to FIGS. 7 and 8 wherein it will be seen that the winding mechanisms of FIGS. 1, 4, and 5, because of their compact arrangements, can be mounted in modular form on the same or opposite sides of a cabinet 62. It is to be understood that each winding mechanism will be in and of itself complete, and will be so mounted on the cabinet 62 that it may be readily removed in its entirety and replaced for repairs or adjustments.

If desired, each cabinet 62 may be mounted on a suitable base 64 and provided with wheels such as casters 66 for movement and placement. Further, as is shown in FIG. 8, the winding mechanisms 10 may be mounted on opposite sides of the cabinet 62 as to permit the mounting of a maximum number of winding units within an alloted space. As further shown in FIG. 8, by using the take-up mechanism illustrated in FIGS. 1–4 the fanning length of the strand, and thus the length of the take-up mechanism, can be substantially reduced without a reduction in the fanning angle. This permits the inclusion of a greater number of modular units in a given floor-to-ceiling installation.

The take-up units of this invention are particularly convenient in that the take-up mechanism has been engineered so that the strand guide snaps into and out of the traverse mechanism, the guide rollers snap off for convenient replacement and cleaning, and the electronics of the control mechanism snap out as a complete unit, no tools being required. Additionally, the winding head and components thereof are easily removable for cleaning and replacement. The electronics and electrical connections of the unit are completely sealed to avoid the possibility of fire or the like due to the presence of particulate material being wound. These features, made possible as a result of the compact winding mechanism, are important in commercial modifications of the unit.

Although only preferred embodiments of the invention have been specifically illustrated and described herein, it is to be understood that minor variations may be made in the compensator wheel and the mounting thereof without departing from the spirit or scope of the invention as defined by the appended claims.

It is claimed:

1. In a take-up mechanism for winding a strand comprising a winding mechanism for receiving a strand to be wound, a drive mechanism for driving said winding mechanism, and drive control means for controlling the winding speed of said drive mechanism, including a compensator wheel unit, the improvement wherein said compensator wheel unit includes a mounting arm, a support mounted on said mounting arm for pivotal movement about a first axis fixed relative to said mounting arm, and a compensator wheel carried by said support for rotation relative to said support and for pivoting with said support about said fixed axis, said first fixed axis being aligned with the path of a strand to said compensator wheel, and means mounting said mounting arm for movement in accordance with strand loop tension on said compensator wheel to actuate said drive control means to thereby control winding speed.

2. A take-up mechanism according to claim 1 wherein said support is L-shaped so as to position said compensator wheel relative to said support and said first fixed axis whereby the path of a strand from said compensator wheel generally lies in a central plane of said compensator wheel in all operative pivoted positions of said compensator wheel.

3. In a take-up mechanism for winding a strand comprising a winding mechanism for receiving a strand to be wound, a drive mechanism for driving said winding mechanism, and drive control means for controlling the winding speed of said drive mechanism, including a compensator wheel unit for controlling winding speed, said compensator wheel unit including a mounting arm, a support pivotally mounted on said mounting arm for pivoting about a first axis fixed relative to said mounting arm, a compensator wheel carried by said support for rotation relative to said support and for pivoting with said support about said first fixed axis, and means mounting said mounting arm for longitudinal movement along a second fixed axis in accordance with strand loop tension on said compensator wheel to actuate said drive control means to thereby control winding speed.

4. A take-up mechanism according to claim 3, said second fixed axis being generally parallel to said first fixed axis.

5. A take-up mechanism according to claim 3, including yarn traversing guide means arranged with drive means for pivoting said compensator wheel in accordance with the actuation of said yarn traversing guide means.

6. A take-up mechanism according to claim 5 wherein said drive means includes a drive wheel extending from support means for said compensating wheel, cable means attached to said yarn traversing guide means, and said cable driving said drive wheel through pulley means.

7. A take-up mechanism according to claim 1, including yarn traversing guide means arranged with drive means for pivoting said compensator wheel in accordance with the actuation of said traversing unit.

8. A take-up mechanism according to claim 7 wherein said drive means includes a drive wheel extending from said support means for said compensating wheel, cable means attached to said yarn traversing guide means, and said cable driving said drive wheel through pulley means.

9. In a take-up mechanism for winding a strand comprising a winding mechanism including strand traversing means for recieving a strand to be wound, a drive mechanism for driving said winding mechanism, and drive control means for controlling the winding speed of said drive mechanism, including a compensator wheel unit for receiving a loop of the strand being wound and controlling winding speed, said compensator wheel having an arcuate concave strand guiding surface for maintaining a strand in contact with said compensator wheel as the strand traverses from one side to the other of a central plane of said compensator wheel while preventing damage to the strand, said compensator wheel being mounted for movement towards and away from a strand winding location longitudinally of a fixed axis for actuating said drive control means to thereby control winding speed.

10. A take-up mechanism according to claim 9 wherein said concave strand guiding surface is of a constant radius.

11. A take-up mechanism according to claim 9 wherein said concave strand guiding surface is of a constant radius ranging from one inch to seven and one-half inches.

12. A take-up mechanism according to claim 9 wherein said concave strand guiding surface is of a constant radius ranging from one inch to seven and one-half inches, and said compensator wheel has a central diameter ranging from one and three-quarters inch to five and one-half inches.

13. A take-up mechanism according to claim 9 wherein said concave strand guiding surface is of a constant radius, and said compensator wheel has a central diameter ranging from one and three-quarter inch to five and one-half inches.

14. A take-up mechanism according to claim 9 including a support pivotally mounting said compensator wheel for pivoting about a fixed pivot axis as the strand traverses to thereby maintain the central plane of said compensator wheel generally in alignment with the strand path from said compensator wheel.

15. A take-up mechanism according to claim 14 wherein said fixed axis is coextensive with the strand path towards said compensator wheel.

16. A take-up mechanism according to claim 15 wherein said support is mounted for movement towards and away from a strand winding location longitudinally of a second fixed axis for controlling winding speed.

17. A take-up mechanism according to claim 14 wherein said support is mounted for movement towards and away from a strand winding location longitudinally of a second fixed axis for controlling winding speed.

18. A take-up mechanism according to claim 14 wherein said compensator wheel support is mounted for movement longitudinally of a second fixed axis disposed substantially parallel to said fixed pivot axis.

* * * * *